US005607319A

United States Patent [19]

Wakata et al.

[11] Patent Number: 5,607,319

[45] Date of Patent: Mar. 4, 1997

[54] METHOD AND APPARATUS FOR ENGAGING HINGED TERMINAL HOUSINGS

[75] Inventors: Shigekazu Wakata; Takatoshi Katsuma; Hideki Matsunaga; Eiji Saijo, all of Yokkaichi, Japan

[73] Assignee: Sumitomo Wiring Systems, Ltd., Mie, Japan

[21] Appl. No.: 338,733

[22] Filed: Nov. 9, 1994

[30] Foreign Application Priority Data

Nov. 19, 1993 [JP] Japan ..... 5-314570

[51] Int. Cl.[6] ..... H01R 13/62

[52] U.S. Cl. ..... 439/341

[58] Field of Search ..... 439/341, 376

[56] References Cited

U.S. PATENT DOCUMENTS 4,923,408 5/1990 Zinn ..... 439/341
5,431,573 7/1995 Endo et al. ..... 439/341

FOREIGN PATENT DOCUMENTS 8627007 2/1987 Germany .
4334929 4/1994 Germany .
60-178978 11/1985 Japan .
6-124747 5/1994 Japan .

*Primary Examiner*—Gary F. Paumen
*Attorney, Agent, or Firm*—Oliff & Berridge

[57] ABSTRACT

An engagement type connector assembly in which the arrangement of terminals is miniaturized. The connector assembly includes male and female connectors in which the female connector swings about a pair of supporting shafts provided at its end so as to be engaged with the male connector. The female connector includes a female housing and an outer frame. A pair of rotating shafts protrudes from the female housing in such a manner that the rotating shafts are in parallel with the supporting shafts so that the female housing is swingably coupled to the outer frame through the rotating shafts. That is, the female housing is supported through the rotating shaft on the outer frame. Hence, in engaging the female connector with the male connector by swinging the female connector, the female housing is allowed to swing independently of the outer frame, thus being correctly aligned with the male housing. Therefore, the inlets of the female terminals into which the male terminals are inserted may be made more compact. Additionally, the electrode spacing interval can be reduced commensurately because the female terminals engage the male terminals in a non-oblique or substantially straight manner.

17 Claims, 4 Drawing Sheets

METHOD AND APPARATUS FOR ENGAGING HINGED TERMINAL HOUSINGS

BACKGROUND OF THE INVENTION

This invention relates to an easy engagement type connector assembly. Connector assemblies having a number of terminals require a large engaging force. In order to overcome the difficulty; i.e., to reduce the engaging force as much as possible, a variety of connector assemblies have been proposed in the art.

An example of the connector assemblies thus proposed is a so-called "easy" engagement type connector assembly or turning-engagement type connector assembly, as shown in FIG. 6. The connector assembly includes a male connector 30 and a female connector 31. The male connector 30 is provided below a female connector 31. The male connector 30 and the female connector 31 include a male housing 32 and a female housing 33, respectively, that are engageable with each other. The male housing 32 has a raised piece 34 on one side that is integral with the male housing 32. The raised piece 34 has a recess 36 that is adapted to hold the supporting shaft 35 of the female connector 31. The supporting shaft 35 is provided outside the female housing 33. The supporting shaft 35 is fitted in the recess 36, which allows the female connector 31 to swing about the supporting shaft 35, to thereby engage with the male connector 30. The female housing 33 has a locking piece 37 on the side that is opposite to the side where the supporting shaft 35 is provided, while the male housing 32 also has a locking piece 38 on the side that is opposite to the side where the raised piece 34 is provided.

When the male and female connectors 30 and 31 engage, the locking piece 38 of the female connector 31 is engaged with the locking edge 42 of the locking piece 37 of the male connector 30, to lock the male and female connectors to each other.

The conventional engagement type connector assembly suffers from several problems. That is, in the conventional connector assembly, the female housing 33 is aligned with the male housing 32 while describing an arcuate locus; that is, the female terminals 39 approach the male terminals 40 obliquely from above. Therefore, in order to smoothly engage the female terminals with the male terminals, the female terminals 39 must have inlets 41 (FIG. 7) that are widely opened for insertion of the male terminals 40. Accordingly, in the conventional connector assembly, the female terminals 39 require large amounts of space between each electrode, which results in a bulky connector assembly.

SUMMARY OF THE INVENTION

In view of the foregoing, an object of the invention is to provide an engagement type connector assembly in which the arrangement of the terminals is reduced in electrode interval for miniaturization of the housing.

The foregoing object of the invention has been achieved by the provision of an engagement type connector assembly including a male connector and a female connector that are engageable with each other. A first of the male and female connectors has a supporting shaft at the end portion of the first connector, while a second of the first and second connectors has a recess that engages with the supporting shaft. The first connector includes an outer frame on which the supporting shaft is mounted, and a housing that is swingably supported on the outer frame by a rotating shaft that is substantially parallel with the supporting shaft.

According to another aspect of the invention, there is provided a connector assembly comprising a first connector housing a plurality of first terminals and including an articulation recess; a second connector including a supporting shaft mounted in the articulation recess, and a plurality of second terminals cooperating with the plurality of first terminals; and means for maintaining the plurality of first and second terminals substantially parallel while the second connector is articulated about the supporting shaft relative to the first connector.

According to still another aspect of the invention, there is provided a connector assembly comprising a first connector having a plurality of first terminals; a second connector having a plurality of second terminals, said second connector being rotatively coupled to said first connector; and means for engaging the first and second terminals in a substantially simultaneous manner when the first connector rotates with respect to the second connector.

According to yet another aspect of the present invention, there is provided a method for connecting first and second connectors that are connected in a hinge type fashion. The method includes the steps of providing the first and second connector with cooperating terminals; rotating the first connector with respect to the second connector about a first axis; and maintaining parallelism between the cooperating terminals during the rotating step.

In order to engage the male and female connectors with each other, one of the connectors is swung towards the other. In this operation, although the outer frame is inclined, the housing of the first connector is correctly aligned with the housing of the other connector because the housing of the one connector which is swung is swingably coupled to the outer frame through the rotating shaft; that is, it is swingable independently of the outer frame. Thus, the male and female connectors are smoothly engaged with each other.

The connector assembly comprising the male and female connectors according to the invention has the following effects or merits: Because the housing of one of the two connectors that is swung towards the other is so designed that it is swingable about an axis which is different from the axis about which the one connector is swung, the two connectors can be engaged with each other with the housing of the first connector correctly aligned with the housing of the second connector. Therefore, in the connector assembly, the terminal interval can be decreased as compared to the conventional engagement type connector assembly. This results in a miniaturization of the connector assembly.

DETAILED DESCRIPTION OF PREFERRED EMBODIMENTS

Figure 1:
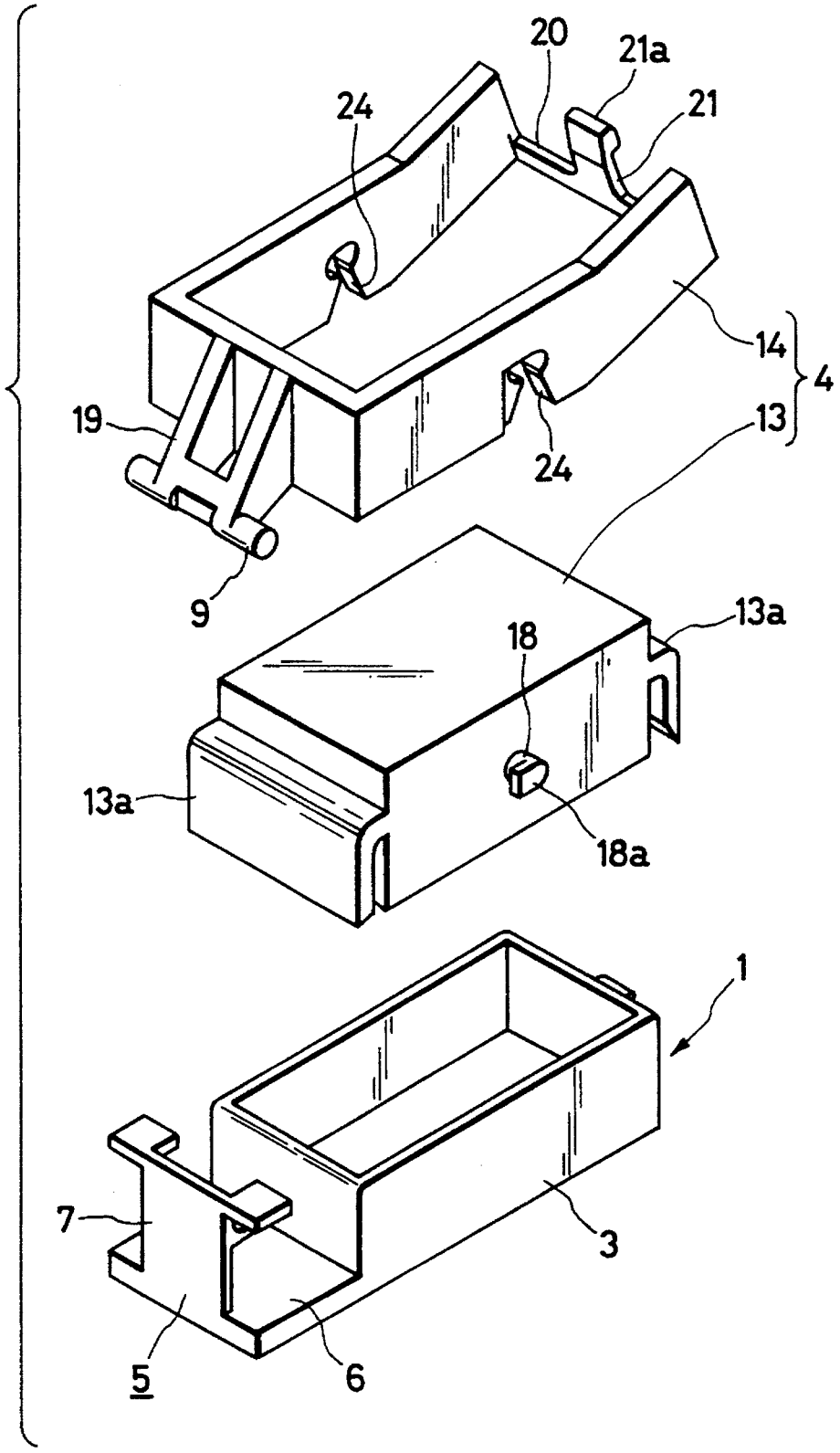
FIG. 1 is an exploded view of an easy engagement type connector assembly showing male and female connectors according to the invention.

One preferred embodiment of this invention will be described with reference to the accompanying drawings. FIG. 1 is an exploded view of an engagement type connector assembly according to the invention. In FIG. 1, reference numeral 1 designates a male connector, which has a male housing 3 accommodating a number of male terminals 2 (not shown in FIG. 1). The male housing 3 is in the form of an upwardly opened box. The male housing 3 has a supporting section 5 on one side that is adapted to support a female connector 4. The supporting section 5 is connected to the male housing 3 through a connecting piece 6 that extends outwardly from the bottom of the male housing 3. The supporting section 5 includes a raised piece 7 that extends upwardly from the outer end of the connecting piece 6. A pair of supporting arms 8 and 8 extend from the upper end portion of the raised piece 7 towards the male housing 3, and have recesses 10 and 10, respectively, which are engaged with a supporting shaft 9 (described later). That is, the supporting arms 8 and 8 swingably support the female connector 4.

The male housing 3 is further provided with an engaging piece 11 on the other side, which is opposite to where the raised piece 7 is provided. More specifically, the engaging piece 11 extends upwardly from the end of a connecting piece 12 that extends from the bottom of the male housing 3. The engaging piece 11 is substantially in the form of a U-shaped frame. The engaging piece 11 has an upper edge that is engageable with a locking piece 21 (described later).

Figure 5:
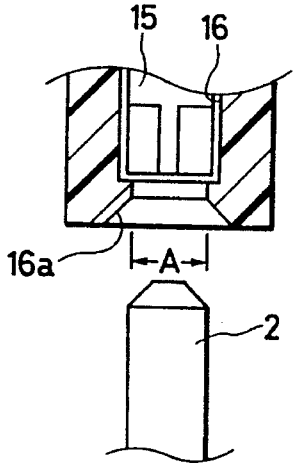
FIG. 5 is an enlarged sectional view showing terminals in the connector assembly.
Figure 6:
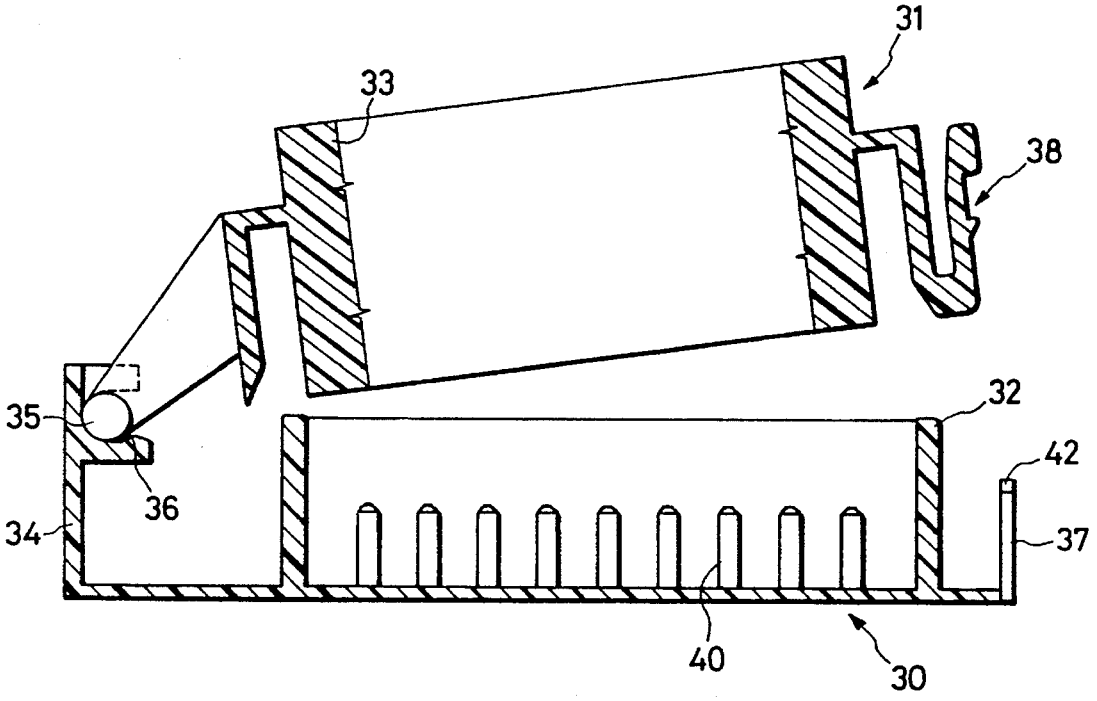
FIG. 6 PRIOR ART
FIG. 6 is a sectional view showing the male and female connector of a conventional easy engagement type connector assembly.
Figure 7:
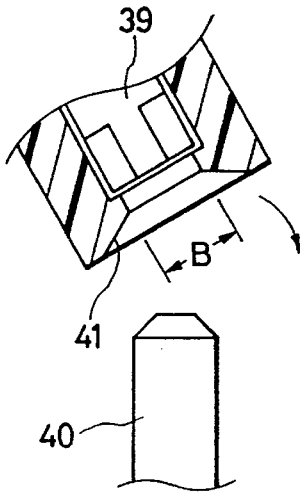
FIG. 7 PRIOR ART
FIG. 7 is an enlarged sectional view showing terminals in the conventional connector assembly.

The female connector 4 is designed to include a female housing 13 and an outer frame 14 surrounding the female housing 13. The female housing 13 is so designed in dimension as to be fitted in the male housing 3, and has as many female terminals 15 (FIG. 5) as the male terminals 2 in the male housing. When the male and female housings 3 and 13 are engaged with each other, the female terminals are electrically connected to the male terminals. The inside of the female housing 13 is divided into a plurality of terminal accommodating chambers 16 in correspondence to the plurality of female terminals 15. The female terminals 15 are fixedly set in the terminal accommodating chambers 16, respectively, in such a manner that they are prevented from disengaging the chambers 16. Each of the chambers 16 is open at both ends; however, one of the openings, namely, an inlet 16*a* into which the male terminal is inserted, is countersunk; i.e, opened wide. The width A of the opening is smaller than the width B of the opening in the conventional connector assembly (A<B) (compare FIGS. 5 and 7).

Two guide walls 13*a* and 13*a* extend from the two short sides walls of the female housing 13 in such a manner that the inner surfaces of the guide walls 13*a* and the outer surfaces of the short side walls of the female housing 13 form insertion grooves 17 that are large enough in width to receive upstanding sidewalls 200, 200 of the male housing 3, respectively. A pair of rotating shafts 18 extends outwardly from the centers of the long side walls of the female housing 13, so that the female housing 13 is coupled through the rotating shafts 18 to the outer frame 14 (only one rotating shaft 18 being shown in the figures). In this embodiment, each of the rotating shafts 18 has a flange 18*a* at the end to prevent relative lateral movement between the female housing 13 and the outer frame 14.

The outer frame 14 is so shaped that it surrounds the female housing 13 with a predetermined gap between the frame 14 and the side walls of the female housing 13. When the male and female housings 3 and 13 are engaged with each other, the side walls of the male housing 3 are inserted in the gap. A projection 19 extends obliquely downwardly from one of the short side walls of the outer frame 14, and has a pair of supporting shafts 9 and 9 at the lower end that extend horizontally. The supporting shafts 9 are fitted in the recesses 10 of the arms 8, thus allowing the outer frame 14 to swing together with the female housing 13. The other short side wall of the outer frame 14 is opened except its lower end portion; that is, the other short side wall is a coupling wall 20 that has a centrally located locking piece 21. The locking piece 21 is bendable and extends vertically. The coupling wall 20 has a locking protrusion 22 at the middle that is selectively and elastically engaged with the engaging piece 11 of the male connector 1. The upper end portion of the locking piece 21, namely, a disengaging part 21*a* is relatively large in thickness. Depression of the disengaging part 21*a* causes the locking protrusion 22 to disengage the engaging piece 11.

A pair of coupling grooves 24 and 24 are formed in the two long side walls of the outer frame 4 at the middle, respectively, which extends downwardly to engage with the rotating shafts 18 of the female housing 13, respectively. In order to facilitate the insertion of the rotating shafts 18 into the coupling grooves 24, the grooves 24 are spread outwardly. Each of the coupling grooves 24 includes a deep end portion where the rotating shaft 18 is set, and an elongated shaft guiding portion along which the rotating shaft is moved so as to be set in the deep end portion. Between the deep end portion and the elongated shaft guiding portion, the groove is made smaller in width so as to prevent the shaft from coming off the deep end portion of the coupling groove 24. The deep end portions of the coupling grooves 24 are larger in diameter than the rotating shafts 18; that is, the shafts 18 are loosely fitted in the deep end portions of the coupling grooves 24, respectively.

Figure 2:
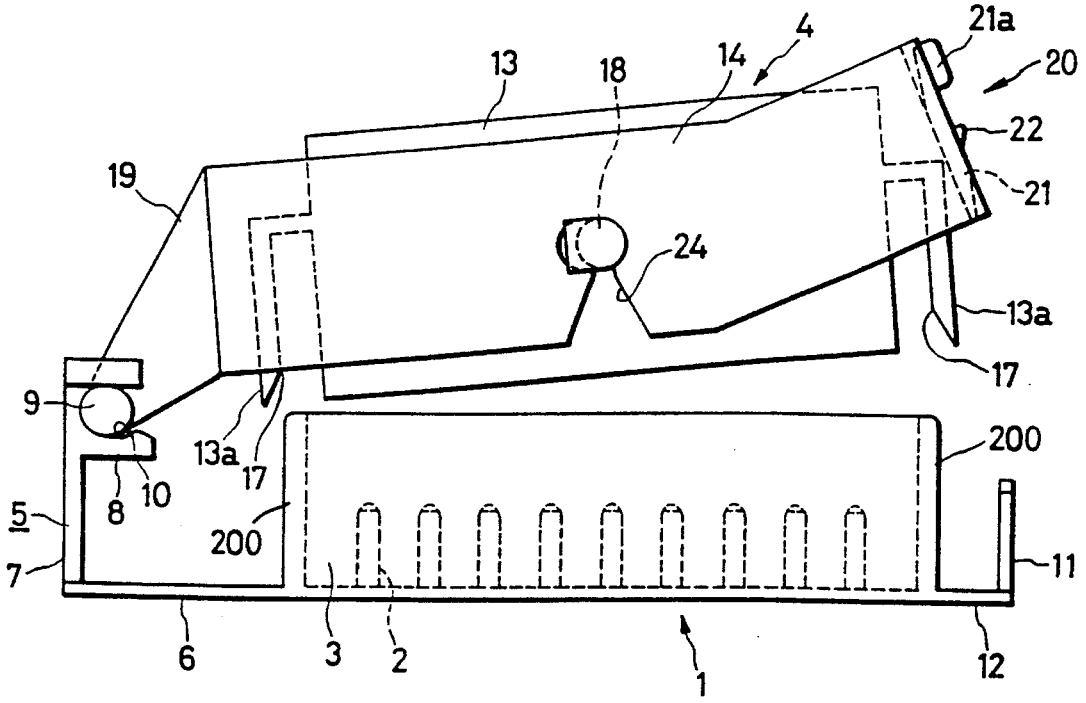
FIG. 2 is a side view showing the male and female connectors of the connector assembly just prior to engagement.

Substantially half of the outer frame 14 extends from the coupling grooves 24 to the right in FIG. 2 (towards the locking piece 21) and is bent upwardly so that, when the male housing 3 engages with the female housing 13, the outer frame 14 does not interfere with the surface on which the female connector 4 is set.

Figure 3:
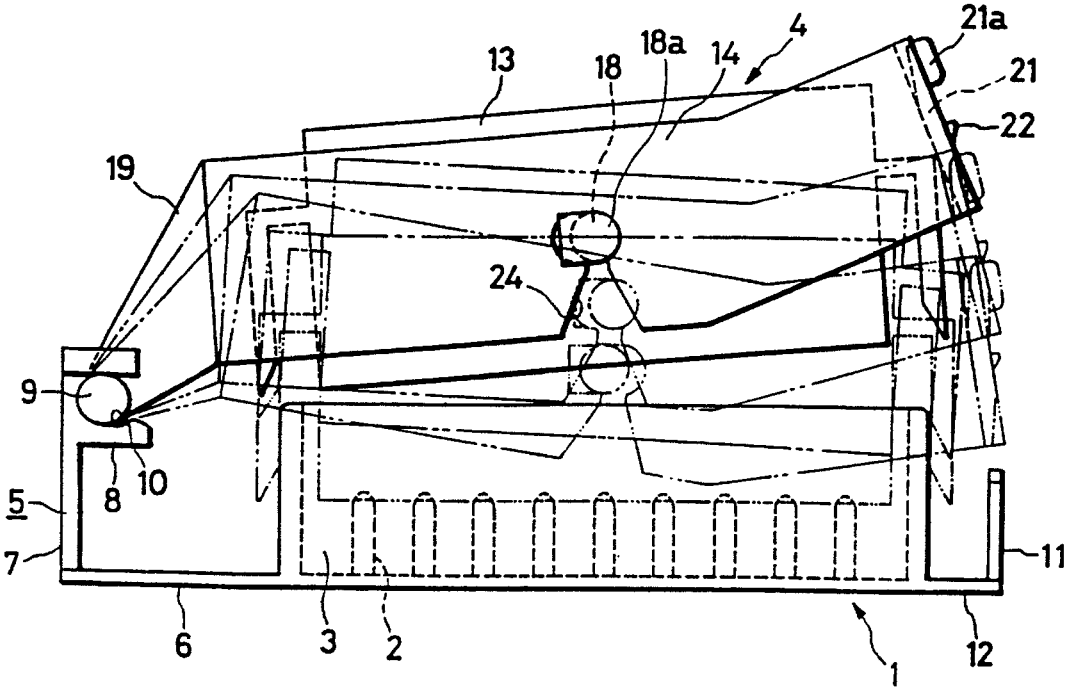
FIG. 3 is a side view showing the male and female connectors during initial engagement.
Figure 4:
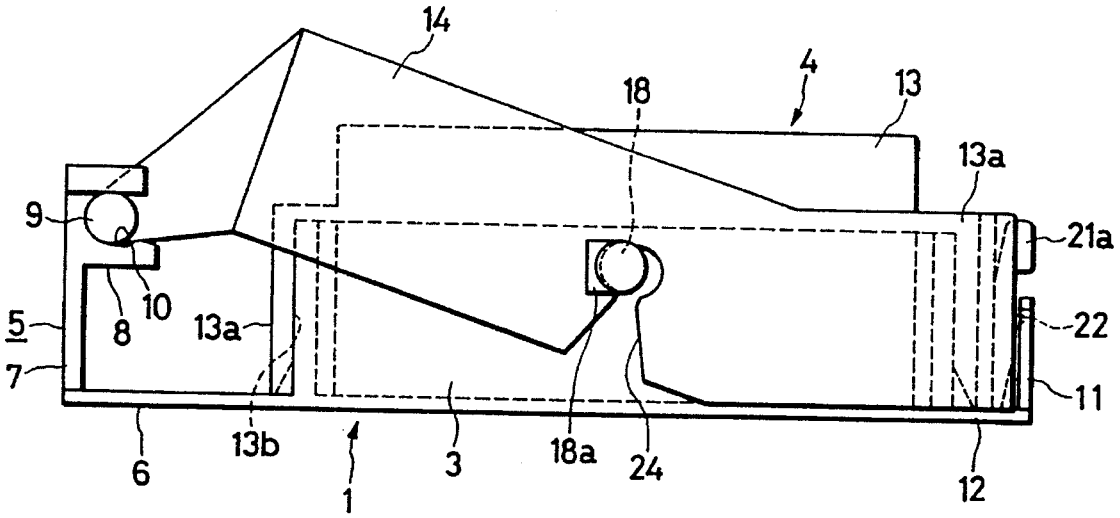
FIG. 4 is a side view showing the male and female connectors that have been engaged with each other.

The connecting operation between the male and female connectors will now be described with reference to FIGS. 3–4. As the female connector 4 is swung about the supporting shafts 9, the outer frame 14 is moved while describing an arcuate locus. In this operation, because the female housing 13 is swingably supported by the rotating shafts 18, the female housing 13 approaches the male housing 3 while being maintained substantially horizontal relative to the outer frame 14. The housing 13 and the outer frame 14 rotate about the recess 10 until the terminals in the housing 13 make initial contact with the terminals in the male housing 3, whereupon the outer frame continues to rotate about the supporting shafts 9 whereas the housing 13 rotates about rotating shafts 18 to align the corresponding terminals so that all the mating terminals engage each other at substantially the same time. During the period after initial contact, movement between the mating terminals is substantially linear because any further rotation of the outer frame about the supporting shaft which would otherwise cause the mating terminals to engage in an oblique manner is compensated by virtue of the independent rotation ability of housing 13 about rotating shafts 18.

Even in the initial period of engagement of the two housings 3 and 13, the female housing 13 is swingable independently of the outer frame 14. Therefore, while the side walls of the male housing 3 are being inserted into the insertion grooves 17 of the guide walls 13*a*, adjustment in alignment of the male and female housings 3 and 13 is achieved smoothly. Hence, in this embodiment, although the inlets 16*a* of the terminal accommodating chambers 16 are smaller in width than those in the conventional connector assembly, the male terminals 2 and the female terminals 15 are smoothly engaged with each other in a non-oblique or linear fashion. As the two housings 3 and 13 are engaged with each other in the above-described manner, the locking piece 21 is engaged with the engaging piece 11 to maintain the two connectors 1 and 4 engaged with each other.

As was described above, in the connector assembly according to the invention, the female housing 13 is swingably supported relative to the outer framed 14, so that the two housings 3 and 13 are readily aligned with each other. Hence, the male and female terminals can be smoothly engaged without the inlets 16*a* of the female terminals 15 being increased in width, which permits miniaturization of the connector assembly.

While the invention has been described in connection with preferred embodiments thereof, it will be obvious to those skilled in the art that various changes and modifications may be made therein without departing from the spirit and scope of the invention, as set forth in the appended claims. For instance, in the above-described embodiment, the female connector is swung; however, the invention is not limited thereto or thereby. That is, the connector assembly may be so modified that, instead of the female connector, the male connector is swung. Furthermore, in the above-described embodiment, the supporting shafts 9 are provided for the female connector, and the recesses 10 for the male connector; however, the connector assembly may be so modified that the female connector has the recesses 10, and the male connector has the supporting shafts 9. This technical concept may be applied to the relation between the rotating shafts 18 and the coupling grooves 24. In addition, it is not always necessary for the rotating shafts 18 to be integral with the housing; that is, the rotating shafts 18 may be separated from the housing.

We claim:

1. An engagement type electrical connector assembly comprising a male connector and a female connector that are engageable with each other, a first of the male and female connectors having a supporting shaft at an end portion of the first connector, a second of the male and female connectors having a recess in which the supporting shaft is engaged so that the first connector is swingable about the supporting shaft to engage the second connector, wherein the first connector comprises an outer frame on which the supporting shaft is mounted, and a housing that is swingably supported on the outer frame by a rotating shaft that is substantially parallel with the supporting shaft, and wherein the rotating shaft is mounted on the housing of the first connector, and the outer frame includes a coupling groove into which the rotating shaft is inserted, and further wherein the coupling groove is widened at an open end thereof.

2. The connector assembly of claim 1, wherein the outer frame includes a locking protrusion and a corresponding locking piece that cooperate with an engaging piece mounted on the second connector.

3. The connector assembly of claim 2, wherein the engaging piece is mounted to the second connector through a connecting piece, and the locking protrusion and locking piece are disposed between the engaging piece and upstanding walls of the second connector when the locking piece and the engaging piece engage.

4. The connector assembly of claim 2, wherein the outer frame includes a disengaging part that is depressable to separate the locking piece from the engaging piece.

5. An engagement type electrical connector assembly comprising a male connector and a female connector that are engageable with each other, a first of the male and female connectors having a supporting shaft at an end portion of the first connector, a second of the male and female connectors having a recess in which the supporting shaft is engaged so that the first connector is swingable about the supporting shaft to engage the second connector, wherein the first connector comprises an outer frame on which the supporting shaft is mounted, and a housing that is swingably supported on the outer frame by a rotating shaft that is substantially parallel with the supporting shaft, and wherein the outer frame includes an upper wall having a first portion and a second portion that is angled upwardly with respect to the first portion, said outer frame including a distal end wall positioned opposite said supporting shaft, said second portion being substantially normal to the distal end wall.

6. An engagement type electrical connector assembly comprising a male connector and a female connector that are engageable with each other, a first of the male and female connectors having a supporting shaft at an end portion of the first connector, a second of the male and female connectors having a recess in which the supporting shaft is engaged so that the first connector is swingable about the supporting shaft to engage the second connector, wherein the first connector comprises an outer frame on which the supporting shaft is mounted, and a housing that is swingably supported on the outer frame by a rotating shaft that is substantially parallel with the supporting shaft, and wherein the housing includes a guide wall mounted on each of two opposite sides of the housing, and further wherein the housing and each said guide wall form an insertion groove for receiving upstanding walls of said second connector.

7. An electrical connector assembly comprising:

a first connector housing a plurality of first terminals and including an articulation recess;

a second connector including a supporting shaft mounted in said articulation recess and including a plurality of second terminals cooperable with said plurality of first terminals; and means for maintaining the plurality of first and second terminals substantially parallel while the second connector is articulated about the supporting shaft relative to the first connector, wherein the second connector includes an outer frame and a housing supported by the outer frame, and said means comprises a coupling groove on one of the outer frame and housing and a rotating shaft on the other of the outer frame and housing, the rotating shaft being received within the coupling groove for rotatably supporting the housing relative to the outer frame, and wherein the rotating shaft includes a flange mounted at an end of the rotating shaft to prevent relative lateral movement between the housing and the outer frame.

8. The connector assembly of claim 7, wherein said supporting shaft is mounted on said outer frame, and said outer frame and said housing articulate about said articulation recess until the plurality of first and second terminals initially contact, whereby the outer frame continues to articulate while relative movement between the plurality of first and second terminals is substantially linear.

9. The connector assembly of claim 7, wherein said housing and said outer frame are independently articulated.

10. The connector assembly of claim 7, wherein the outer frame includes a locking mechanism that cooperates with an engagement mounted on said first connector, and the housing includes guide walls that abut upstanding walls of the first connector.

11. The connector assembly of claim 7, further comprising a locking mechanism for coupling the first and second connectors, and guide walls for facilitating engagement between the first and second connectors.

12. The connector assembly of claim 11, wherein the locking mechanism and the guide walls are independently rotatable.

13. An electrical connector assembly comprising:

a first connector having a plurality of first terminals;

a second connector having a plurality of second terminals electrically cooperable with the plurality of first terminals, said first and second terminals being disposed along substantially an entire length of said first and second connectors, respectively;

a housing rotatably mounted to both said first connector and said second connector said first connector, including said plurality of first terminals, being rotatively movable with respect to both said housing and said second connector; and means for engaging the plurality of first terminals with the plurality of second terminals in a substantially simultaneous manner along the entire length of said first and second connectors when the first connector rotates with respect to the second connector.

14. The connector assembly of claim 13, wherein the housing is supported by an outer frame that is rotatively mounted to said second connector, and said means comprises coupling grooves formed on opposite side walls of one of the outer frame and the housing and rotating shafts on the other of the outer frame and the housing, said rotating shafts being received with said coupling grooves for rotatably supporting the housing relative to the outer frame.

15. A method of connecting first and second electrical connectors that are connected in a hinge type fashion, comprising the steps of:

providing each of the first connector and the second connector with cooperating terminals;

rotating the first connector with respect to the second connector about a first axis until the cooperating terminals initially contact each other substantially simultaneously along an entire length of the first and second connectors, respectively; and maintaining parallelism between the cooperating terminals following said rotating step as the cooperating terminals linearly slide with respect to one another along the entire length of the first and second connectors.

16. The method of claim 15, wherein the step of maintaining parallelism includes the steps of:

pivotally supporting a housing on the first connector for pivotal movement relative to the first connector along a second axis parallel to the first axis; and pivotally moving the housing about the second axis while rotating the first connector about the first axis to align terminals in the housing with terminals in the second connector.

17. The method of claim 15, wherein the step of maintaining parallelism includes the step of substantially simultaneously engaging terminals in the housing with terminals in the second connector.

* * * * *